US005331790A

United States Patent [19]

Benner, Jr. et al.

[11] Patent Number: 5,331,790

[45] Date of Patent: Jul. 26, 1994

[54] POUCH CONDITIONING METHODS AND APPARATUS

[75] Inventors: Harold T. Benner, Jr., Cincinnati, Ohio; Gary A. Dunhoft, Burlington, Ky.; Mark D. Smith, Batavia, Ohio

[73] Assignee: R. A. Jones & Co. Inc., Crescent Springs, Ky.

[21] Appl. No.: 21,205

[22] Filed: Feb. 23, 1993

[51] Int. Cl.[5] ..... B65B 1/22; B65B 1/24; B65B 35/56

[52] U.S. Cl. ..... 53/437; 53/113; 53/251; 53/439; 53/530

[58] Field of Search ..... 53/437, 439, 438, 436, 53/446, 475, 473, 428, 530, 529, 525, 523, 113, 251, 255; 198/408, 404

[56] References Cited

U.S. PATENT DOCUMENTS

| | | | |
|---|---|---|---|
| 2,247,175 | 6/1941 | Orstrom | 198/404 |
| 3,604,689 | 9/1971 | Hutcheson | 53/437 X |
| 3,641,737 | 2/1972 | Tamagni | 53/554 |
| 3,777,453 | 12/1973 | Zimmermann | 53/251 |
| 3,903,672 | 9/1975 | Goglio | 53/437 |
| 3,927,508 | 12/1975 | Campbell, III | 53/251 |
| 4,394,899 | 7/1983 | Fluck | 198/408 |
| 4,627,215 | 12/1986 | Walz | 53/246 |
| 4,669,600 | 6/1987 | Fluck | 198/408 |
| 4,819,411 | 4/1989 | Konzal et al. | 53/113 X |
| 4,922,688 | 5/1990 | Langen et al. | 53/437 X |
| 5,025,612 | 6/1991 | Monsees | 53/530 |
| 5,060,450 | 10/1991 | Greenwell et al. | 53/113 |
| 5,155,972 | 10/1992 | Monsees | 53/436 |

FOREIGN PATENT DOCUMENTS

| | | | |
|---|---|---|---|
| 2544024 | 4/1977 | Fed. Rep. of Germany | 53/113 |
| 14436 | 1/1991 | Japan | 53/113 |

*Primary Examiner*—James F. Coan
*Attorney, Agent, or Firm*—Wood, Herron & Evans

[57] ABSTRACT

A pouch conditioner inverts a group of pouches, urges them together while conditioning the by vibrating them, reinverts them and deposits them into a confine container. Product is more evenly dispersed throughout the pouch, reducing the maximum pouch thickness and allowing packaging of a group of pouches in a smaller case than possible with pouches having product which is settled in the pouch bottom.

23 Claims, 5 Drawing Sheets

POUCH CONDITIONING METHODS AND APPARATUS

This invention relates to packing of product containing pouches into containers and more particularly to apparatus and methods for conditioning pouches for packaging.

Among other applications, flexible wall pouches are used in packaging of products such as powder or granular products, i.e. sugar, sweeteners, cocoa mix, and the like. When these pouches are filled and otherwise handled for packaging, the product settles in the pouch, expanding the pouch bottom and leaving the top of the pouch devoid of product. This setting thus thickens the pouch bottom or that lowest area of the pouch where product settles.

When a plurality of pouches are oriented face-to-face for packaging, the thickened bottoms define the distance which must be provided between any container walls for confirming that particular group of pouches. In other words, if pouches having settled product are packed together, the minimum distance or size is a function of the thickened pouch bottoms, and is greater than would be necessary if the product was evenly distributed throughout the pouch so that it was of uniform thickness. The space at the top of the container is wasted, as the pouch tops are not filled out with product.

Accordingly, it is one objective of this invention to provide improved apparatus and methods reducing the size of containers necessary to package a given number of flexible pouches.

A further objective of the invention is to provide apparatus and methods for conditioning pouches for packaging by more evenly dispersing product throughout the pouches.

To these ends, a preferred embodiment of the invention contemplates the conditioning of pouches by inverting the pouches, confining the inverted pouches face-to-face while conditioning the pouches by vibrating them or by applying and releasing force while they are confined and, while maintaining the pouches in confined condition, reinverting them and depositing them in a bucket loader for packaging in a container. The apparatus of the preferred embodiment thus includes means for inverting a group of pouches, means for urging the pouches together face-to-face while at the same time conditioning them by vibrating them and means for reinverting the confined and conditioned group and for loading them into a container.

More specifically, pouches are loaded between two lugs of a lug conveyor and introduced between leading and trailing edges of an inverted tray carried on a conveyor operating transversely to the lug conveyor. The tray is moved to sweep the pouches from between two or more lugs edgewise around a shroud, inverting them. From there, the pouches rest in the trays and are conveyed by the trays between two vibrating guide rails, inclined toward one another. These vibrating rails urge the pouches together while conditioning and confining them. The pouches are then swept around another shroud, reinverting them, and are discharged into a bucket conveyor, all while maintained in a confined condition.

These methods and apparatus substantially condition the pouches so the product therein is more evenly distributed, thereby permitting them to be packed in a much smaller space than if expanded by product settling. A larger number of pouches can thus be packed in smaller container space. Also, when presented in display cases, the removal of the first several pouches does not tend to allow remaining pouches to fall over forwardly in improper presentation position, where only the pouch backs are visible. Pouches are more attractively presented and easier to handle.

These and other objectives and advantages will become readily apparent from the following detailed description of a preferred embodiment, and from the drawings in which.

Figure 1:
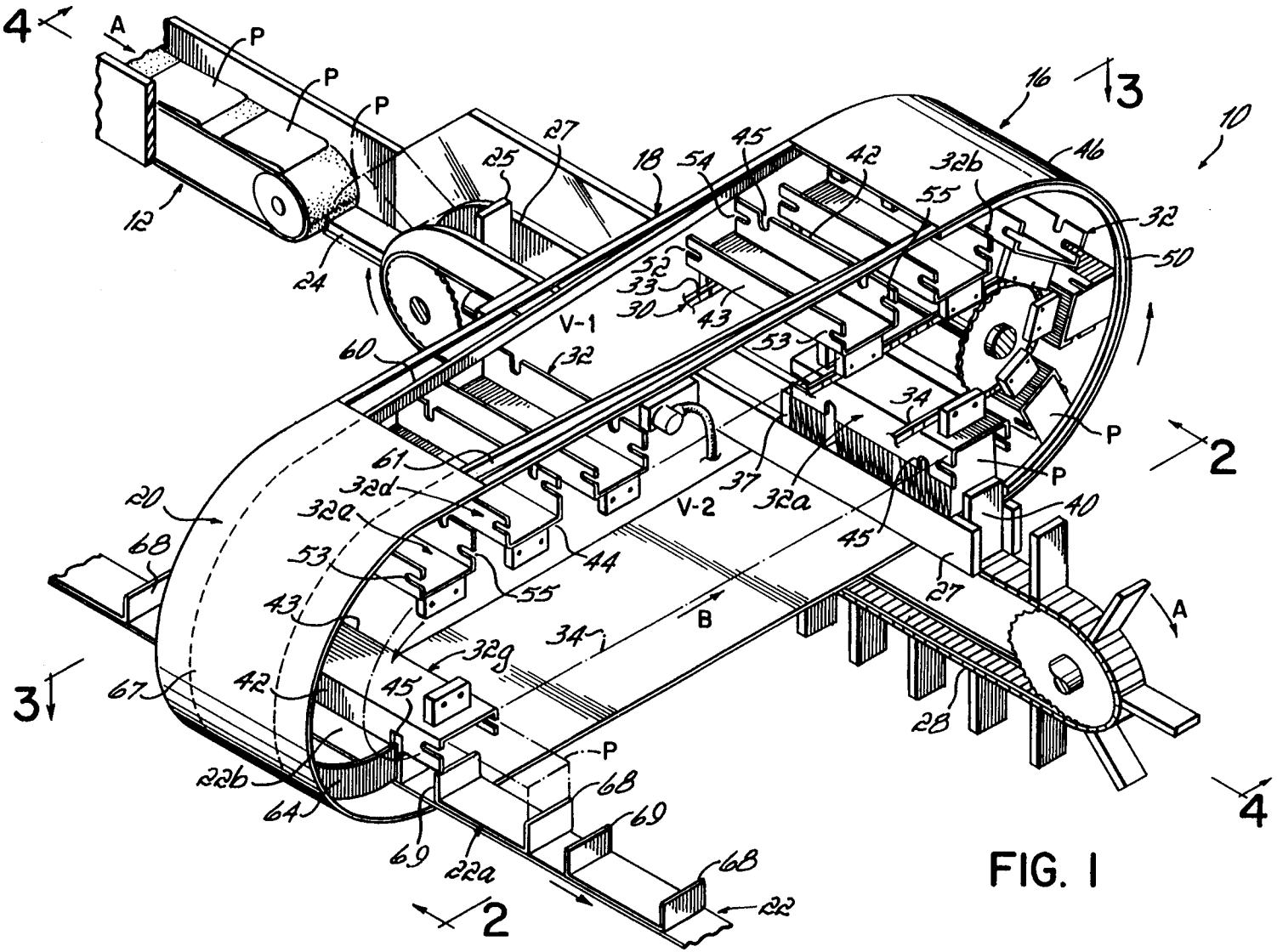
FIG. 1 is a perspective view of a preferred embodiment of the invention.

Turning now to the drawings, there is shown in FIG. 1 a preferred embodiment of a pouch conditioning apparatus 10. The apparatus as shown in FIG. 1 includes a pouch feeding unit 12 for feeding pouches P to a pouch lug conveyor 14. The pouch lug conveyor 14 is operatively associated with a pouch inverter station 16, from which extends a pouch confining and conditioning area 18. A pouch reinverter station 20 is operatively associated with the pouch confining and conditioning area 18 and is adapted for discharging pouches into a bucket conveyor 22.

A very brief synopsis Of the operation of the invention may be helpful to an understanding of the various methods and apparatus disclosed in the Figures.

Single pouches P are fed from the pouch feed apparatus 12 onto the lug conveyor 14 so that a number of pouches are disposed between each of the lugs on the conveyor. As the pouches P are fed into the lug conveyor 14, product in the pouches tends to settle at the leading edge of the pouch. Depending on the feed orientation, this could be a bottom, top or side of the pouch as will be appreciated. For purposes of description, the leading edge will be considered to be the pouch bottom. Of course, the invention is useful to evenly disperse product throughout the pouch P despite its original orientation.

These pouches P are conveyed by lug conveyor 14 to the inverting station 16, where a number of pouches P are introduced into an inverted tray 32 between the leading and trailing edges thereof. The tray 32 is mounted on a conveyor 30 which moves transversely with respect to the lug conveyor 14 and at a pre-disposed time as operable, to sweep the pouches P out from between the lugs and upwardly in a semi-circular path at the pouch inverter station 16. From there, a group of pouches P are introduced to the pouch confining and conditioning area 18 where the trays which are now opened upwardly, convey the pouches between two inclined vibrating rails 60, 61, which both confine the pouches closer together in a face-to-face orientation and vibrate to condition them. As the pouches move downstream, they are reinverted at the reinvert station 20 and from there are discharged into a waiting bucket of the bucket conveyor 22, from where they can be loaded into a container, such as a display case, for example. Accordingly, the apparatus as shown in FIG. 1 is capable of inverting a plurality of pouches P, confining and conditioning the pouches, reinverting the pouches and loading them into a confined container, such as the bucket of a bucket conveyor, for further packaging into a case or the like.

Figure 4:
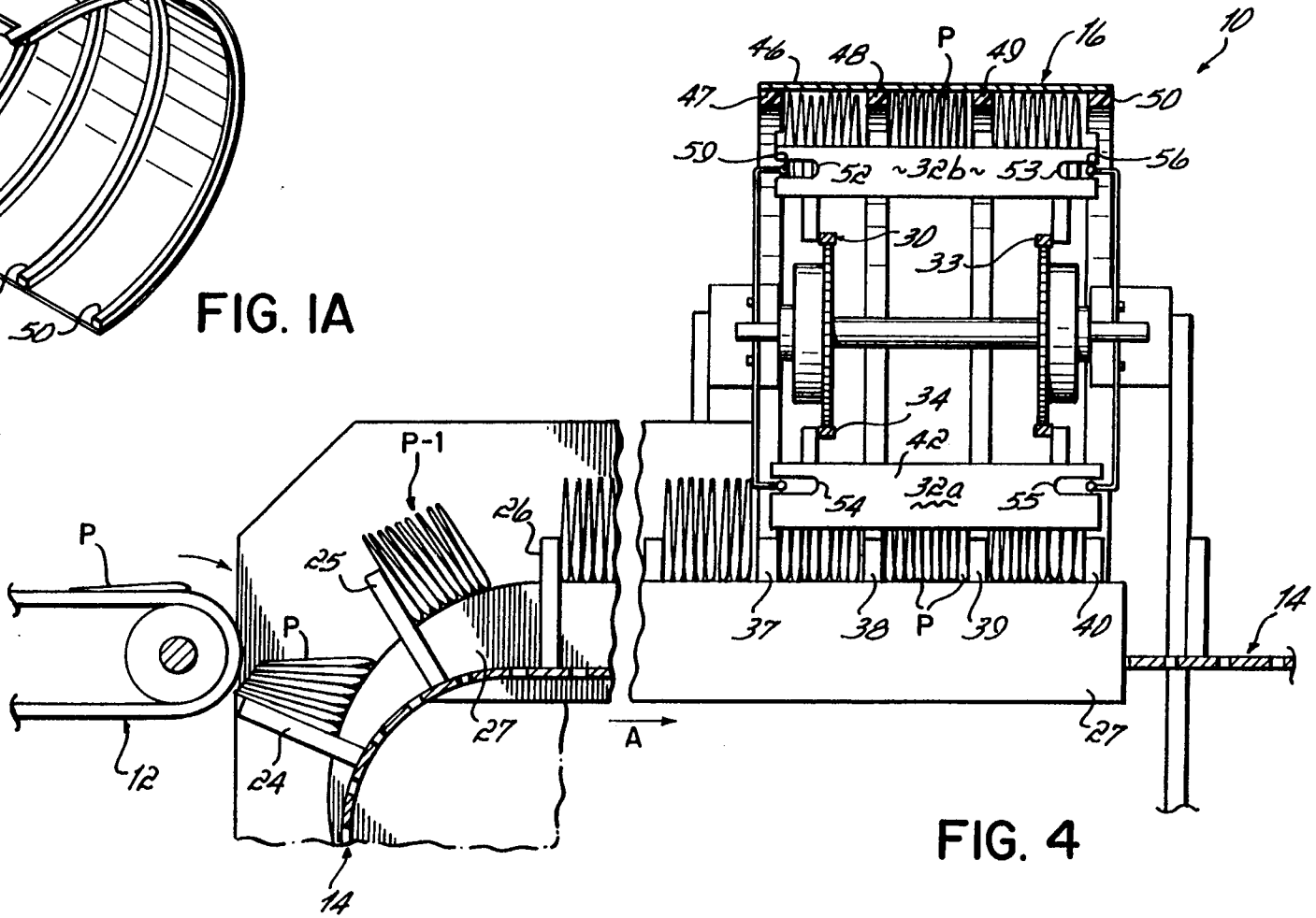
FIG. 4 is a cross sectional view taken along lines 4—4 of FIG. 1.
Figure 1A:
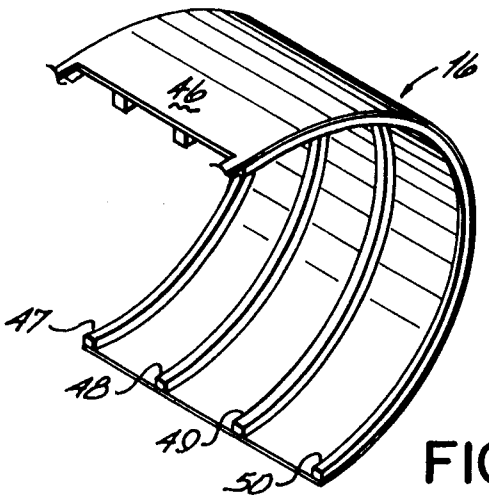
FIG. 1A is a view of the righthand shroud of FIG. 1 showing details excepted from FIG. 1 for clarity.

Turning now to the details of the invention, and with respect to FIGS. 1 and 4, it will be appreciated that the pouch infeed device or apparatus 12 may comprise any form of conveyor or feeding device for feeding individual pouches, which are either separated, shingled or grouped, into the spaces between the lugs of the lug conveyor 14. One form of useful pouch feeding apparatus is shown in U.S. Pat. No. 4,585,113, expressly incorporated herein by reference, the details of which are not included in FIGS. 1 or 4. Such apparatus is operable to group pouches or conveyor 12 in a prescribed count for filling the lug conveyor 14. Other forms of feeders or grouping apparatus could be used, and feed conveyor 12 is diagrammatically shown in illustrate but one apparatus for feeding the lug conveyor 14 with pouches.

As shown in FIG. 4, lugs 24 and 25 are positioned with respect to a discharge end of the feed apparatus 12 to receive a plurality of pouches P therebetween. Another group of pouches P-1 have already been loaded between lugs 25 and 26 of the conveyor 14, which has moved in the direction of the arrow A to present the area between lugs 24 and 25 for filling with the pouches P. As the pouches are introduced between the lugs 24 and 25, for example, it will be appreciated that some settling of the product in the leading edges of the pouches takes place.

In particular, pouches P discussed herein comprise flexible wall pouches which have been filled and sealed by any appropriate means, so as to contain the product therein. Such pouches may be formed of plastic, paper or aluminized material, for example, and sealed about their edges so as to efficiently contain the product therein. Such product, for purposes of this discussion, is generally a granular or aggregate product and may be in powder form. Included are such products as sugars, sweeteners, cocoa mix and the like, although it should be appreciated that the invention may be found useful for conditioning various types of pouches carrying various types of products.

With further attention to FIG. 4, it will be appreciated that as the lug conveyor 14 moves in a direction of arrow A, the pouches ride up on a bottom guide 27, so that the tops of the pouches reside above the tops of the respective lugs as shown in FIG. 4. The lug conveyor 14 transfers the pouches to the inverter station 16, where the pouches are removed from the lugs and the lugs are then conveyed about a return run 28, as shown in FIG. 1.

Figure 2:
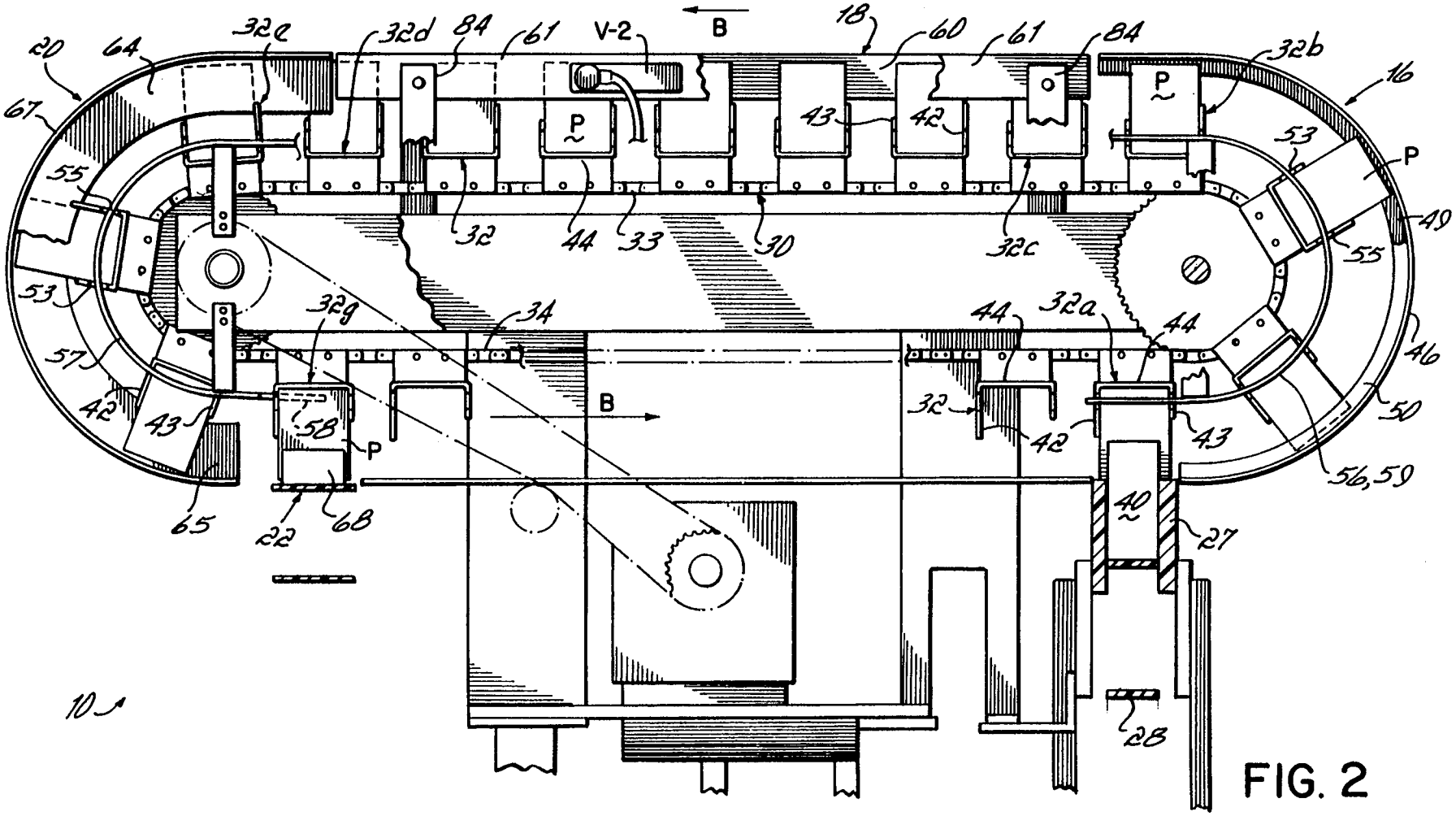
FIG. 2 is an elevational end view taken along lines 2-2 of FIG. 1.

It will be appreciated that the pouch conditioner 10 is disposed transversely to the lug conveyor 14 and as well to the bucket conveyor 22. The pouch conditioner 18 is operable in the direction of the arrows B (FIG. 2) to transfer pouches P between the lug conveyor 14 and the bucket conveyor 22, as will be described. The inverter 10 includes, as noted above, an invert station 16 and a preferably reinvert station 20 connected operably by a pouch confining and conditioning area 18. The inverter 10 includes a conveyor 30 carrying a plurality of pouch trays 32. As perhaps best seen in FIG. 2, these trays 32 are carried by the conveyor 30 with a rectilinear motion in an upper run 33 and a lower run 34, interconnected by the semicircularly disposed invert and reinvert stations 16 and 20. A first tray 32*a* is disposed over the lug conveyor 14 generally over lugs 37, 38, 39 and 40, as perhaps best seen in FIG. 4. The tray 32*a*, as well as all the other trays, has a trailing edge 42, a leading edge 43 and a bottom 44. As shown in FIGS. 1, 2 and 4, the tray 32*a* extends over lugs 37 through 40 of the lug conveyor 14 in an adverted fashion, so the tray 32*a* opens or faces downwardly. In this position, the tray 32*a* can be filled with the upper ends of the pouches P disposed between lugs 37 through 40, such that the tops of the pouches which clear the tops of those lugs, reside in the tray 32*a*.

It will be appreciated then that the tray is filled with three sets of pouches, the first set between lugs 39 and 40, the second between lugs 38 and 39 and the third set between lugs 37 and 38. In the preferred embodiment, these three sets of pouches will be inverted, confined, conditioned, reinverted and loaded into a bucket of the bucket conveyor 22 as a single group or plurality of pouches. Accordingly, once the tray 32*a* is filled, the conveyor 30 is indexed to move the pouches transversely from the lug conveyor 14 and upwardly into the shroud 46 of the invert station 16.

Shroud 46 is provided with four internal guides 47 through 50, which are screwed to the shroud in order to minimize any gaps between the bottoms of the guides and the interior surface of the shroud 46. It will be appreciated that the pouches are moved transversely from the lug conveyor 14 in an edgewise direction into, and eventually upwardly and around the shroud 46, as illustrated in FIG. 2, to a position where the pouches are held, such as in a tray at the position 32*b* (FIG. 2). It will be appreciated that the motion of the conveyor 30 is intermittent and that preferably for each motion, a new tray 32 is positioned over the lug conveyor 14 to receive pouches as noted above. Once the trays 32 are indexed away from the lug conveyor, the lug conveyor is then indexed to bring a new number of groups of pouches P into the invert station 16 and beneath an inverted tray 32.

It will be appreciated that each of the trays 32 has, in its trailing edge 42, slots 45 for accommodating any lug thereunder. Also, it will be appreciated that the leading edges 43 of the trays 32 are provided with inwardly directed slots 52 and 53, while the trailing edges 42 are provided with an inwardly directed slots 54 and 55. The slots 52 and 54, and the slots 53 and 55, are disposed in the tray edges for receiving a curved, rod-like guide, useful for confining the endmost pouches in the plurality of pouches maintained in the tray 32. Such a guide is shown, for example, at 56 in FIG. 2. Another such guide 57 is shown at the reinvert station 20. Such guides are provided on both sides of the invert and reinvert stations, such that a guide 58 in similar fashion, is disposed behind the guide 57 at the reinvert station 20, while a similar rod-like guide 59 is disposed around the other side of the invert station 16, as shown in FIG. 2. The guides 56 and 59 are depicted in cross section in FIG. 4.

With respect to FIG. 2, it will be appreciated that the pouches P in the tray 32*b* have reached a position where they are now 180 degrees opposed to their position as they entered the tray 32*a*, and are thus inverted 180 degrees. When the conveyor 30 is again indexed, the pouches in the tray 32*b* will move to the position of the pouches in the tray 32*c*, for example, where the pouches now are removed from the influence of the invert station 16 and the guides therein, and are introduced between two elongated guides 60 and 61. Guides 60 and 61 are disposed along a path of motion of the pouches through the confining and conditioning area 18. The guides 60 and 61 are adjustably inclined inwardly toward each other, as perhaps best seen in FIG. 3. A group of pouches P are confined between the guides 60 and 61 with those guides engaging the outside faces of the endmost ones of the pouches. As the trays 32 move in the direction of the arrow B, the pouches are thus confined or urged in a face-to-face direction toward each other, thereby compressing the group of pouches, from their spread apart configuration in a tray 32*c*, for example, to their compressed together condition at tray 32*d*, for example. At the same time, each of the guides 60 and 61 is provided with a vibrator mechanism, V1 and V2, for vibrating the guide rails 60 and 61. The rails 60, 61 are mounted on flexible standards 84 to accommodate their vibration. The vibrators V1 and V2 may be any form of suitable vibrator, and may be electronically, pneumatically or mechanically driven, and may comprise solenoids, eccentric cams or any other device suitable for connection to the rails 60, 61 and for vibrating them. Currently, the vibration frequency and the vibration amplitude is not believed to be particularly critical. One form of vibrator which has been found useful is pneumatic vibrator Model No. US13, manufactured and distributed by Global Manufacturing Company of Little Rock, Ark.

Figure 3:
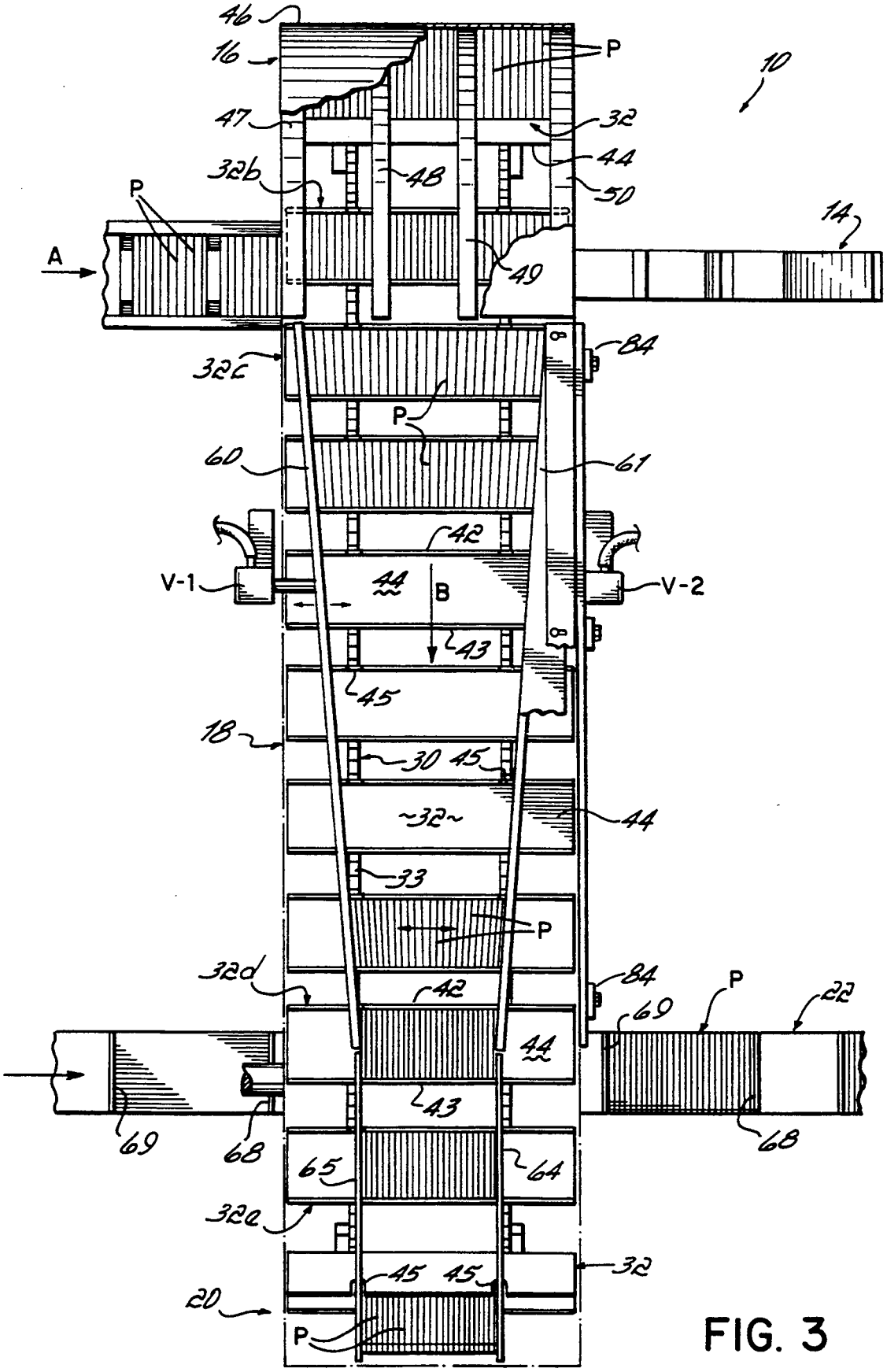
FIG. 3 is a partial top plan view taken along lines 3—3 of FIG. 1.

As the tray 32*d* is indexed, it moves into the position of the tray 32*e* and the pouches therein are confined by a set of complimentary guides 64 and 65 (FIGS. 2 and 3). Thereafter, the trays are further indexed about the shroud 67 to the position of the tray 32*g*, where the tray is thus reinverted from its position at 32*e*, with the slots 45 in the trailing edge 42 accommodating the guides 64, 65 (FIG. 1). Also, it will be appreciated that as the tray moves into the position 32*g*, it sweeps the pouches in an edgewise transverse direction between the ends 68 and 69 of a bucket on a bucket conveyor 22 disposed beneath the inverted tray 32*g*. One bucket 22*a* (FIG. 1) has been so filled and the next trailing bucket 22*b* is in position for filling.

It will also be appreciated that the rod-like guide 57 terminates short of the position of the tray 32*g*, while the rearward guide 58 associated with the shroud 67 extends further into the area, maintaining the pouches in confined configuration. Accordingly, it will be appreciated that as the pouches are introduced to the tray 32*a* on the lug conveyor 14, they are confined at the forward end by the rod-like guide 56 and as they are moved into the shroud 46, they are confined both by the guides 47 through 50 and the guide rods 56, 59, as they are swept around the shroud 46. It will be appreciated that there is preferably no confinement of the pouches in the shroud 46, which may cause undue friction at this point. Instead, the pouches are simply swept upwardly to the position of the tray 32*b*, where they are rather loosely arranged, in view of the fact of the spaces which were created between the three sets of pouches by the lugs 38 and 39 and by the guides 48 and 49. As the tray transfers, however, from the position of the tray 32*b* to the tray 32*c*, it will be appreciated that the pouches are introduced between the guide rails 60 and 61. These rails, being inclined inwardly toward each other, begin to confine the pouches as the pouches are moved in the direction of the arrow B (FIG. 3) between the rails 60, 61, the rails thus confining the pouches P. It is during this confinement that the vibration to the group of pouches is preferably applied by the rails, thus conditioning the pouches. It will also be appreciated that as the pouches are inverted from the position shown on the lug conveyor 14 to their position shown within the tray 32*b*, some redistribution of product within the pouches occurs, from the bottom area of the pouches disposed on the lug conveyor to the top of the pouches, which have now been inverted to the lower position shown in 32*b*, thus relieving some of the expansion of the pouch bottom, which has now been inverted or turned upside down at the upper part of the shroud 46. Subsequently, the pouches are moved along the rails 60, 61, where they are confined and/or vibrated, causing further settling of the product from what is now the top of the pouches, toward the bottom. The progressive confinement urges the pouches together face-to-face so that any product settling is limited. Thereby the pouches are conditioned, while at the same time being confined, so that they can be 25 compressed into a small area, such as that illustrated by the pouches within the tray 32*d* (FIG. 3). As the trays 32 are indexed from the position 32*d*, the pouches enter between the respective guides 64, 65 and the respective rod-like guides 57, 58, which maintain the confined condition of the pouches as they are now reinverted about the reinvert station 20 and moved into the bucket of a bucket conveyor or some other confined container.

While it is preferred that the pouches in this embodiment be introduced to a bucket conveyor for transfer to a further case loading station, it will also be appreciated that the pouches could be swept directly into a case container or some other confined containing means for the pouches.

It will also be appreciated then, that the pouches are inverted and are then urged toward one another, while at the same time being conditioned. Material which had been accumulated or settled in the bottom of the pouch so as to bulge it out is now redistributed downwardly throughout the pouch and toward what is to be the pouch top, which is supported by the trays 32 in the conditioning and confining area 18. Thereafter the pouches, while being compressed together, are introduced to the reinvert station 20, where they are reinverted so as to have the same orientation as they had on the lug conveyor 14, and from where the pouches are dispensed or discharged into a bucket conveyor 22 or other confining means.

Figure 5:
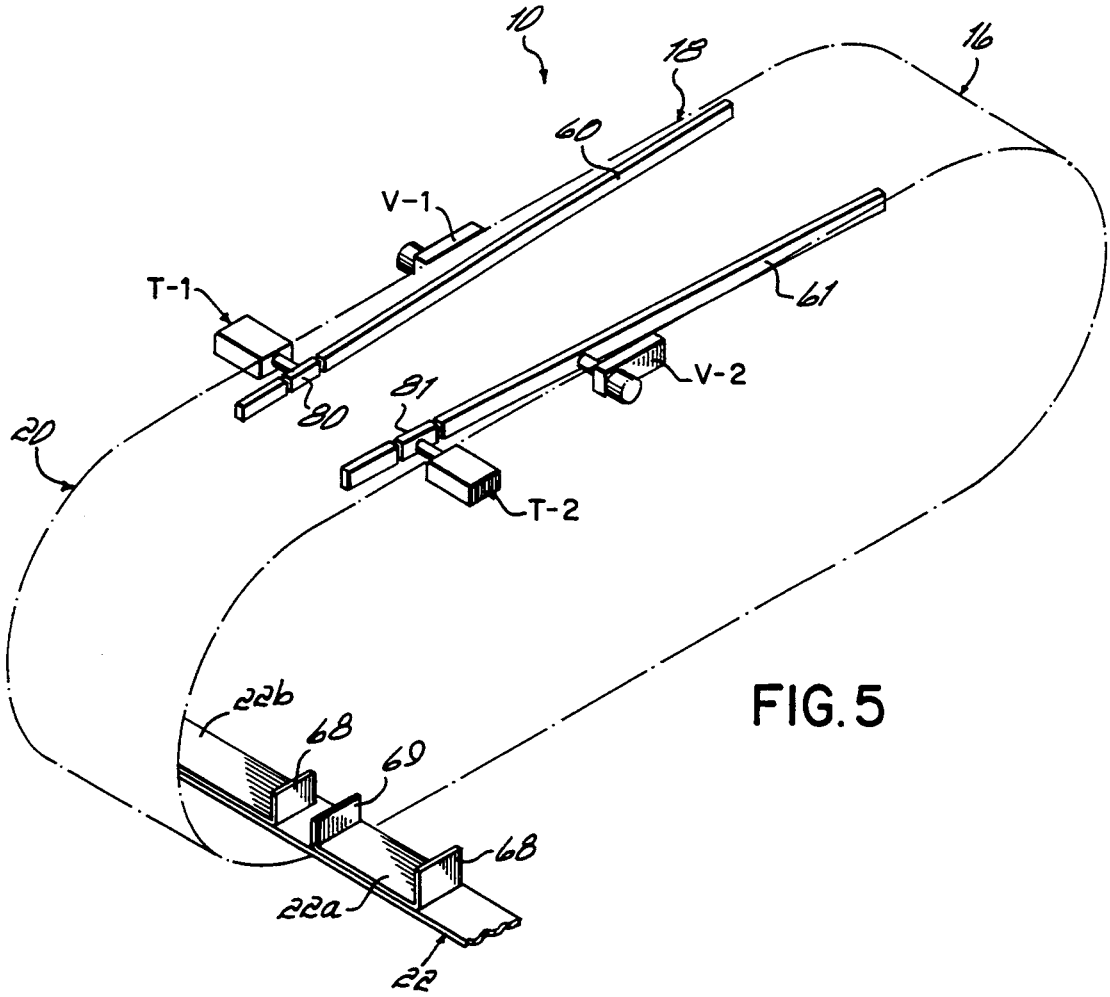
FIG. 5 is a partial perspective view similar to FIG. 1 but illustrating an alternative embodiment of the invention.

In an alternative embodiment, it has been discovered that some further tamping or conditioning of the pouches beyond the rails 60, 61, may be desirable for certain products, pouch sizes or the like. Accordingly, an alternative embodiment of the invention is illustrated in FIG. 5. In this embodiment, the other details of the pouch conditioning apparatus and methods are the same, and the pouches are inverted, then conveyed between the rails 60, 61, where they are confined and conditioned. After being discharged from between the incline rails 60, 61, the pouches are conveyed to a station between tampers T1 and T2. These tampers have pouch engaging tamper members 80 and 81 with faces transversely disposed, so as to lie in a plane parallel to the plane of the outside faces of the endmost pouches in the group of pouches within the tray. When the pouches are indexed to this station, the tampers T1 and T2, which may be electronically or pneumatically operated solenoids or cylinders, for example, extend tamper members 80 and 81 so as to tamp the endmost pouches and thereby further compress the whole group of pouches. It may be only necessary for the tampers T1 and T2 to operate once or twice for each group of pouches, to tamp them further closer together. From there, the tampers 80, 81 remain extended until the pouches are conveyed between further guides 64, 65 and 57, 58 of the reinvert station 20, where the pouch group is discharged to a container means such as a bucket conveyor 22.

It will also be appreciated in a further, alternative embodiment, that use of the tampers T1 and T2 alone, and without any preceding vibration, can be sufficient to condition the pouches. Accordingly, the pouches would in this embodiment be confined by rails 60, 61 but not vibrated. The tampers T1 and T2 would then operate to tamp the pouch group, confining and/or conditioning it.

In another alternative embodiment of the invention shown in FIG. 1, it should also be appreciated that pouches may be conditioned for desirable packaging without vibrating the rails 60, 61, or may be packed as they exit from the rails without being reinverted. Thus, it may only be necessary to invert the pouches and confine them together, with or without reinverting or vibrating them, such activity being enough to sufficiently condition the contents of the pouches so that the product is evenly distributed within the pouches. Nevertheless, it will be appreciated that the combined operation of confining the pouches together, while at the same time further conditioning them by vibrating them, provides a significant improvement to the distribution of the product within the pouches, so that the pouches are relatively uniformly filled out, with the product being evenly distributed therein, so that the face-to-face dimension of each individual pouch is relatively uniform, and so that a group of pouches may be confined together in a minimum amount of space.

In one application, for example, it has been found that pouches of cocoa mix which normally, for example, may be provided in groups of twenty-five, have previously taken up a linear dimension or space of about $8\frac{1}{2}$ inches, while the same pouches conditioned with the apparatus described above may be confined and packaged within a bucket conveyor, pouch confining container, pouch receiver or display case, for example, where the linear dimension is only about $5\frac{1}{2}$ to $6\frac{1}{2}$ inches. It will thus be appreciated that a group of pouches can be confined and conditioned into a space which is much smaller than the previous form of unconditioned pouches may have otherwise permitted.

It will also be appreciated that the invention can operate in the range of up to about 600 pouches per minute or faster, even though the lug conveyor 14, conditioner 10 and bucket loader 22 operate intermittently in a timed sequence.

It will be appreciated that these and other modifications and advantages will be readily apparent to those of ordinary skill in the art, and that applicant intends to be bound only by the claims appended hereto.

I claim:

1. A method of conditioning pouches to minimize the maximum thickness of the pouches, including the steps of:

inverting selected pouches;

confining selected inverted pouches in a face-to-face disposition;

conditioning selected inverted pouches;

reinverting selected pouches; and depositing conditioned pouches into a confined means.

2. A method as in claim 1 wherein the conditioning step is carried out while said pouches are confined.

3. A method as in claim 2 including the step of maintaining confinement of pouches during said conditioning and depositing.

4. A method as in claim 1 wherein said confining step includes introducing pouches between two guides inclined so as to converge toward one another and urging said pouches together in face-to-face disposition by moving said pouches along said guides in the converging direction.

5. A method as in claim 4 wherein said conditioning step includes vibrating said guides and pouches confined therebetween.

6. A method as in claim 5 wherein said reinverting and depositing step includes maintaining pouches in a confined condition while being reinverted and deposited.

7. A method of conditioning pouches including the steps of:

segregating pouches face-to-face into a group of pouches;

inverting the pouch group;

confining the pouches in the group together;

conditioning the pouches while confined;

reinverting the pouch group while maintaining pouch confinement; and discharging the confined pouch groups into a pouch group confining container.

8. A method as in claim 7 wherein the confining step includes urging the pouches in the group together while the conditioning step includes vibrating the pouches.

9. A method as in claim 8 wherein the discharging step includes depositing the confined group of pouches into a bucket conveyor and between end walls thereof having a distance therebetween substantially equal to a confined, conditional, reinverted pouch group.

10. Apparatus for packing pouches including:

means for inverting a plurality of pouches;

means for urging said pouches together face-to-face;

means for conditioning said pouches urged together;

means for reinverting said pouches after said pouches have been conditioned; and means for receiving said pouches from said reinverting means.

11. Apparatus as in claim 10 wherein said inverting means comprises an inverted tray for engaging a top portion of pouches introduced thereto, and for moving said pouches in a direction transverse to faces thereof.

12. Apparatus as in claim 10 wherein said urging means comprises two opposed guides included so as to converge toward one another along opposite sides of a path along which pouches move in an edgewise direction; said guides engaging respective outside pouches in a group of pouches.

13. Apparatus as in claim 12 wherein said conditioning means includes means to vibrate said opposed guides.

14. Apparatus as in claim 11 wherein said trays comprise means for conveying pouches through said urging means between said inverting means and said reinverting means.

15. Apparatus as in claim 10 further including pouch confining means for confining a group of pouches in said reinverting means face-to-face.

16. Apparatus as in claim 10 wherein said receiving means comprises a bucket conveyor.

17. Apparatus as in claim 10 wherein said inverting means comprises a plurality of downwardly facing inverted trays for receiving a plurality of pouches from one tray end, said trays mounted on a conveyor moving the trays in a semicircular path inverting them to upwardly facing orientation for inverting pouches received therein, and wherein said conveyor moves said trays through another semicircular path, reinverting them and pouches therein after said pouches are conditioned by said pouch conditioning means.

18. Apparatus as in claim 17 wherein said pouch conditioning means comprises elongated pouch guide rails extending between said respective semicircular paths on each side of said plurality of pouches.

19. Apparatus as in claim 10 further including means downstream of said urging means for tamping the pouches face-to-face.

20. A method of conditioning pouches including the steps of:

segregating pouches face-to-face into a group of pouches;

inverting the pouch group;

then confining the pouches in the group together;

reinverting the pouch group while maintaining pouch confinement; and discharging the confined pouch groups into a pouch group confining container.

21. Apparatus for packing pouches including:

means for inverting a plurality of pouches;

means for urging said pouches together face-to-face;

means downstream of said urging means for tamping the pouches face-to-face; and means for receiving tamped pouches for packaging in a confining container.

22. Apparatus as in claim 21 further including means for conditioning said pouches as they are being urged together prior to said tamping means.

23. Apparatus as in claim 21 further including means for reinverting said pouches after said pouches have been tamped and before said pouches are deposited in a confining container.

* * * * *